US006932327B2

(12) United States Patent
Alberson et al.

(10) Patent No.: US 6,932,327 B2
(45) Date of Patent: Aug. 23, 2005

(54) CABLE GUARDRAIL RELEASE SYSTEM

(75) Inventors: Dean C. Alberson, Bryan, TX (US); Roger P. Bligh, Bryan, TX (US); D. Lance Bullard, Jr., College Station, TX (US); C. Eugene Buth, Wellborn, TX (US)

(73) Assignee: The Texas A&M University System, College Station, TX (US)

( * ) Notice: Subject to any disclaimer, the term of this patent is extended or adjusted under 35 U.S.C. 154(b) by 0 days.

(21) Appl. No.: 10/355,601

(22) Filed: Jan. 30, 2003

(65) Prior Publication Data

US 2003/0213946 A1 Nov. 20, 2003

Related U.S. Application Data

(60) Provisional application No. 60/353,000, filed on Jan. 30, 2002, and provisional application No. 60/380,632, filed on May 15, 2002.

(51) Int. Cl.[7] ..... E04F 11/00
(52) U.S. Cl. ..... 256/13.1; 404/8
(58) Field of Search ..... 256/13.1, 1; 404/6, 404/7, 8

(56) References Cited

U.S. PATENT DOCUMENTS

| | | | | |
|---|---|---|---|---|
| RE22,060 E | * | 4/1942 | Hayden et al. | 256/13.1 |
| 3,185,445 A | * | 5/1965 | Broadway | 256/13.1 |
| 3,951,556 A | | 4/1976 | Strizk | |
| 4,607,824 A | | 8/1986 | Krage et al. | |
| 4,923,319 A | | 5/1990 | Dent | |
| 4,926,592 A | | 5/1990 | Nehls | |
| 4,928,446 A | | 5/1990 | Alexander, Sr. | |
| 4,928,928 A | | 5/1990 | Buth et al. | |
| 5,214,886 A | | 6/1993 | Hugron | |
| 5,503,495 A | | 4/1996 | Mak et al. | |
| 5,855,443 A | | 1/1999 | Faller et al. | |
| 2003/0015695 A1 | | 1/2003 | Alberson et al. | |

FOREIGN PATENT DOCUMENTS

| | | |
|---|---|---|
| DE | 1459803 | 3/1969 |
| WO | WO 96/20311 | 7/1996 |

OTHER PUBLICATIONS

International Search Report for PCT/US03/02998, 7 pages.
"*INFORMATION: Report 350 Acceptance of New York 3–Strand Cable Terminal*", Memorandum No. HMH-S–CC63 from Dwight A. Home, Director, Office of Highway Safety Infrastructure, U.S. Department of Transportation, Federal Highway Administration, to Resource Center Directors, Division Administrators and Federal Lands Highway Division Engineers, 2 pages Memorandum and 3 pages of Attachments, Feb. 14, 2000.

* cited by examiner

*Primary Examiner*—John R. Cottingham
(74) *Attorney, Agent, or Firm*—Baker Botts L.L.P.

(57) ABSTRACT

A cable guardrail release system includes a first number of anchor posts installed adjacent a roadway. Each of the first number of anchor posts secures an end of a respective cable. Each anchor post is operable to release the respective cable secured by the anchor post upon a vehicle impact to the anchor post. The system may include a length of need section that includes a plurality of intermediate support posts each configured to support each of the respective cables. The length of need section may include portions of each of the respective cables running in between the plurality of intermediate support posts. Each anchor post may be configured to resist release of the respective cable secured by the anchor post upon a vehicle impact to the length of need section generally at an angle to the flow of traffic on the roadway.

16 Claims, 5 Drawing Sheets

CABLE GUARDRAIL RELEASE SYSTEM

RELATED APPLICATIONS

This application claims the benefit of U.S. Provisional Application Ser. No. 60/353,000 filed Jan. 30, 2002, entitled Cable Guardrail Terminal, and U.S. Provisional Application Ser. No. 60/380,632 filed May 15, 2002, entitled Cable Guardrail Terminal.

TECHNICAL FIELD OF THE INVENTION

This invention relates generally to guardrail systems and more particularly to a cable guardrail release system.

BACKGROUND OF THE INVENTION

Guardrail systems are widely used along both sides of roadways to enhance the safety of the roadway and adjacent roadside. Guardrail beams and corresponding support posts may be used to accomplish multiple tasks, such as containing and redirecting an errant vehicle upon impact. Other systems may utilize cables and corresponding support posts to accomplish such tasks. Such systems typically anchor the cables at a foundation block.

SUMMARY OF THE INVENTION

The present invention provides a cable guardrail release system that substantially eliminates or reduces at least some of the disadvantages and problems associated with previous guardrail systems.

In accordance with a particular embodiment of the present invention, a cable guardrail release system includes a first number of anchor posts installed adjacent a roadway. Each of the first number of anchor posts secures an end of a respective cable. Each anchor post is operable to release the respective cable secured by the anchor post upon a vehicle impact to the anchor post.

The system may include a length of need section that includes a plurality of intermediate support posts each configured to support each of the respective cables. The length of need section may include portions of each of the respective cables running in between the plurality of intermediate support posts. Each anchor post may be configured to resist release of the respective cable secured by the anchor post upon a vehicle impact to the length of need section generally at an angle to the flow of traffic on the roadway.

In accordance with another embodiment, a cable guardrail release system includes a plurality of anchor posts installed adjacent a roadway. Each anchor post secures an end of at least one of a plurality of cables. Each anchor post is operable to release the end of the at least one of the plurality of cables secured by the anchor post upon a vehicle impact to the anchor post. Each anchor post may include an upper portion retaining a first slanted plate at a lower end of the upper portion. The first slanted plate may have a first cutout at its lower end. Each anchor post may also include a lower portion coupled to the upper portion for installation at least partially below grade adjacent the roadway. The lower portion may retain a second slanted plate at an upper end of the lower portion. The second slanted plate may have a second cutout at its upper end. The first slanted plate may be adjacent the second slanted plate such that the first cutout of the upper portion and the second cutout of the lower portion align together to form an opening through which the end of the at least one of the plurality of cables secured by the anchor post is disposed. The upper portion may be operable to move relative to the lower portion and release the end of the at least one of the plurality of cables secured by the anchor post upon the vehicle impact to the anchor post.

Technical advantages of particular embodiments of the present invention include a cable guardrail release system that includes cables anchored to cable release anchor posts at different locations. The cables may be anchored to separate posts that release the cables in the event of a vehicle impact to the post. Having at least some cables separately anchored and released facilitates construction and repair of the system and reduces cost.

Other technical advantages will be readily apparent to one skilled in the art from the following figures, descriptions and claims. Moreover, while specific advantages have been enumerated above, various embodiments may include all, some or none of the enumerated advantages.

BRIEF DESCRIPTION OF THE DRAWINGS

For a more complete understanding of particular embodiments of the invention and their advantages, reference is now made to the following descriptions, taken in conjunction with the accompanying drawings, in which.

DETAILED DESCRIPTION OF THE INVENTION

Figure 1:
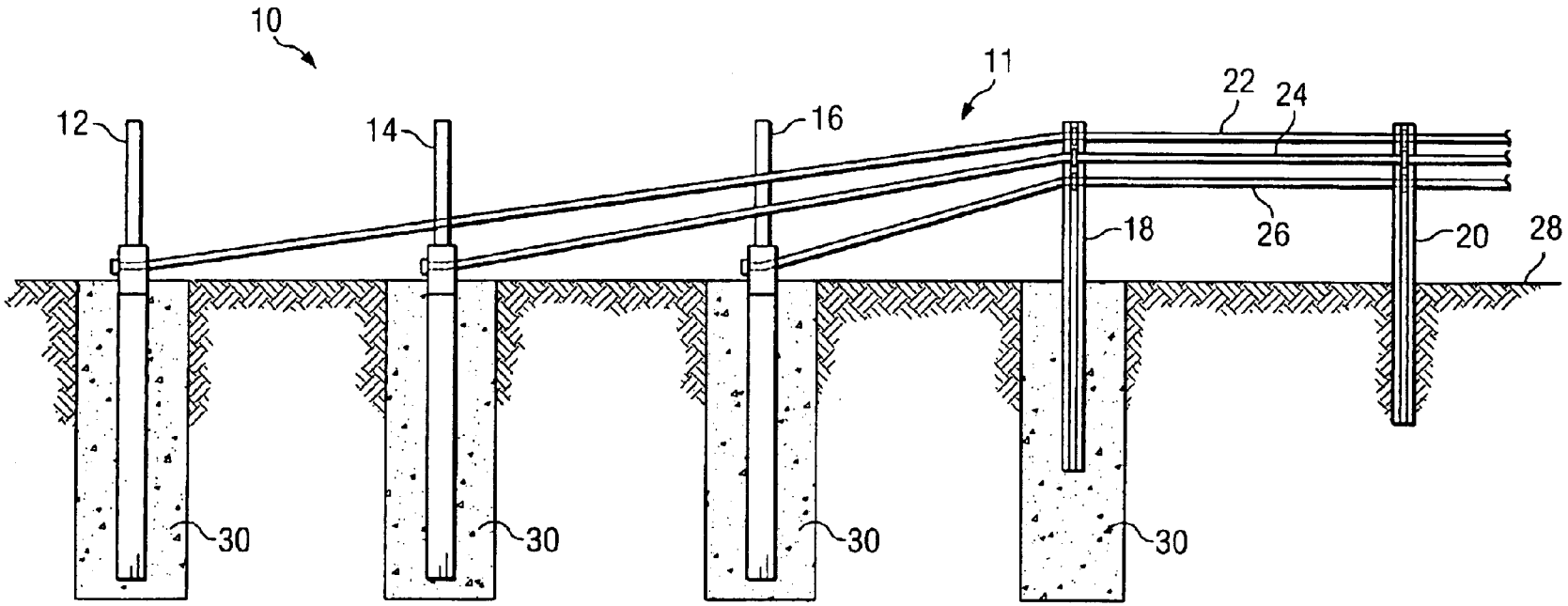
FIG. 1 illustrates a portion of a cable guardrail release system, in accordance with an embodiment of the present invention.

FIG. 1 illustrates a portion of a cable guardrail release system 10, in accordance with an embodiment of the present invention. Cable guardrail release system 10 may be installed adjacent a roadway to protect vehicles, drivers and passengers from various obstacles and hazards and to prevent vehicles from leaving the roadway during a traffic accident or other hazardous condition. Cable guardrail release systems in accordance with embodiments of the present invention may be used in median strips or shoulders of highways, roadways or any path that is likely to encounter vehicular traffic.

The illustrated portion of cable guardrail release system 10 includes intermediate support posts 18 and 20 and a terminal system 11 that includes cable release anchor posts 12, 14 and 16. Intermediate support posts 18 and 20 provide support to cables 22, 24 and 26 (upper cable 22, middle cable 24 and lower cable 26). Cable guardrail release system 10 includes three cables; however, other embodiments may include a cable guardrail release system having fewer or greater than three cables. In particular embodiments, cables 22, 24 and 26 comprise wire rope cables; however, other embodiments may include other types of cables or steel strands. One example cable for use in cable guardrail release system 10 is a 19 mm (0.748 in) diameter 3×7 wire rope.

Each cable 22, 24 and 26 is anchored or secured by, or coupled to, a separate cable release anchor post proximate a ground surface 28. For example, cable 22 is coupled to cable release anchor post 12, cable 24 is coupled to cable release anchor post 14 and cable 26 is coupled to cable release anchor post 16. Terminal system 11 includes three cable release anchor posts; however, other embodiments may include a terminal system with fewer or greater than three cable release anchor posts. For example, some embodiments of the present invention may include four cable release anchor posts that each anchor one of four cables. Cable guardrail release systems in accordance with other embodiments may also include terminal systems with more than one cable coupled to a single cable release anchor post. For example, one embodiment may include a terminal system with four cables and two cable release anchor posts, in which case each cable release anchor post may anchor two cables. Even in such situations, at least some cables are separately anchored and released which facilitates construction and repair of the system.

Cables 22, 24 and 26 are also each secured to intermediate support posts 18 and 20 which support such cables in a generally horizontal and parallel relation above ground surface 28. In the illustrated embodiment, cable release anchor posts 12, 14 and 16 and intermediate support post 18 are securely anchored in concrete footers 30. However, other embodiments may utilize another type of method to anchor the support or anchor posts. For example, some embodiments may utilize sleeves, foundation tubes, ground struts or trapezoidal soil plates to secure posts of a cable guardrail release system under a ground surface.

Figure 2:
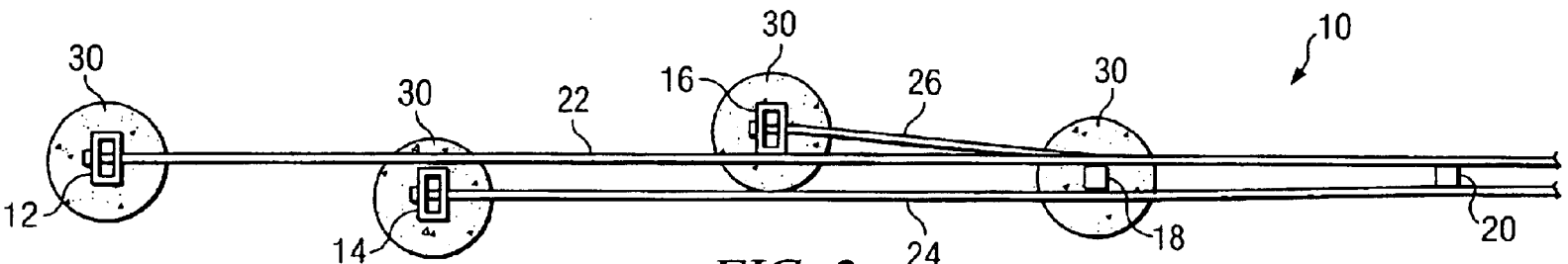
FIG. 2 illustrates the portion of the cable guardrail release system illustrated in FIG. 1 from a top view.

FIG. 2 illustrates the portion of cable guardrail release system 10 illustrated in FIG. 1 from a top view. The orientation and spacing of cable release anchor posts 12, 14 and 16 relative to each other and to intermediate support post 18 may vary in various embodiments. As illustrated in FIGS. 1 and 2, cable release anchor posts may be installed in general alignment with each other and with the running of cables 22, 24 and 26 along the cable guardrail release system 10. In particular embodiments, the spacing between cable release anchor posts 12 and 14, the spacing between cable release anchor posts 14 and 16, and the spacing between cable release anchor post 16 and intermediate support post 18 may be approximately 1.9 meters. In some embodiments the spacing between intermediate support posts 18 and 20 and between other successive intermediate support posts of a cable guardrail release system may be approximately between two and five meters. Particular embodiments may also include cable release anchor posts configured and spaced such that the angle between each cable (as it is anchored to an anchor post) and ground surface 28 is substantially the same. Moreover, in the illustrated embodiment the angle between each cable and the ground surface is a particularly flat one which minimizes the slack which might exist at intermediate support post 18 upon release of one or more of the cables.

As evident, in this particular embodiment upper cable 22 and lower cable 26 are secured to one side of intermediate support posts 18 and 20, while middle cable 24 is secured to the other side of intermediate support posts 18 and 20. This configuration may be particularly suited for installation at a median. Cables of other embodiments may be secured to support posts in other ways or configurations. For example, in some embodiments each cable may be secured to the traffic side of the intermediate support posts. Such a configuration may be particularly suited for roadside, as opposed to median, installation.

It should be understood that cable release anchor posts 12, 14 and 16 of FIGS. 1 and 2 make up only one terminal of a complete cable guardrail release system 10. Thus, cable guardrail release system 10 may include an opposite terminal that includes a number of cable release anchor posts and one or more intermediate support posts between the terminals. Such opposite terminal may be constructed in essentially the same manner as the terminal illustrated in FIGS. 1 and 2. The portion of a guardrail system between and including the intermediate support posts is referred in the art as the system's "length of need." Thus, the length of need section of a cable guardrail safety system may include the intermediate support posts of the system as well as the portions of the cables that run between the intermediate support posts, such as the portions of cables 22, 24 and 26 that run between intermediate support posts 18 and 20 and any other intermediate support post of the system.

Cable guardrail release system 10 is intended to keep errant vehicles from leaving the roadway during a crash or other hazardous situation. In many instances, system 10 is installed between a roadway and a significant hazard to vehicles (i.e. another roadway, a bridge, cliff, etc.). Therefore, cable guardrail release system 10 is able to withstand a significant impact at an angle to the flow of traffic on the roadway, without substantial failure. It is the positive anchorage of the cables that allows cable guardrail release system 10 to withstand such an impact, and still redirect the vehicle so that it is once again traveling generally in the direction of the roadway.

However, testing and experience has continuously shown that guardrail systems may actually introduce additional hazards to the roadway and surrounding areas. This may be particularly true with respect to vehicles that impact the posts of the terminal section of the guardrail system. For example, if the posts of the terminal section were rigidly fixed in place during a collision with the posts, serious injury and damage may result to the errant vehicle, its driver and passengers. Accordingly, many attempts have been made to minimize this added risk.

Some of these methods include vehicle attenuating terminals (VAT), SENTRE end treatments, breakaway end terminals (BET) and the breakaway support posts of U.S. Pat. No. 6,398,192 ("'192 patent"). Many such terminals, supports, end treatments and the like are commercially available from various organizations. Examples include the HBA post by Exodyne Technologies and Trinity Industries, and a breakaway support post similar in configuration to that described in the '192 patent.

Each cable release anchor post 12, 14 and 16 fails and releases its respective cable 22, 24 or 26 in the event of an impact by a vehicle striking the post. The performance of cable guardrail release system 10 is thereby improved since the vehicle is less likely to become hung up on the cable anchored by the post.

In the event that a vehicle strikes cable guardrail release system 10 at a location other than a particular anchor post, then cable release anchor posts 12, 14 and 16 resist release of their respective cables 22, 24 or 26 and hold and anchor their respective cables 22, 24 or 26. Thus, if a vehicle impacts cable guardrail release system 10 at an angle to the flow of traffic at any point along its length of need, then each cable release anchor post 12, 14 and 16 is designed to hold their respective cables 22, 24 or 26 to aid in the redirection of the vehicle toward the roadway. In particular embodiments each cable release anchor post may hold and anchor the cable(s) that it secures in the event of an impact to a separate cable release anchor post. Furthermore, having particular cables of the system separately anchored and released facilitates construction and repair of the system and reduces cost.

Figure 3:
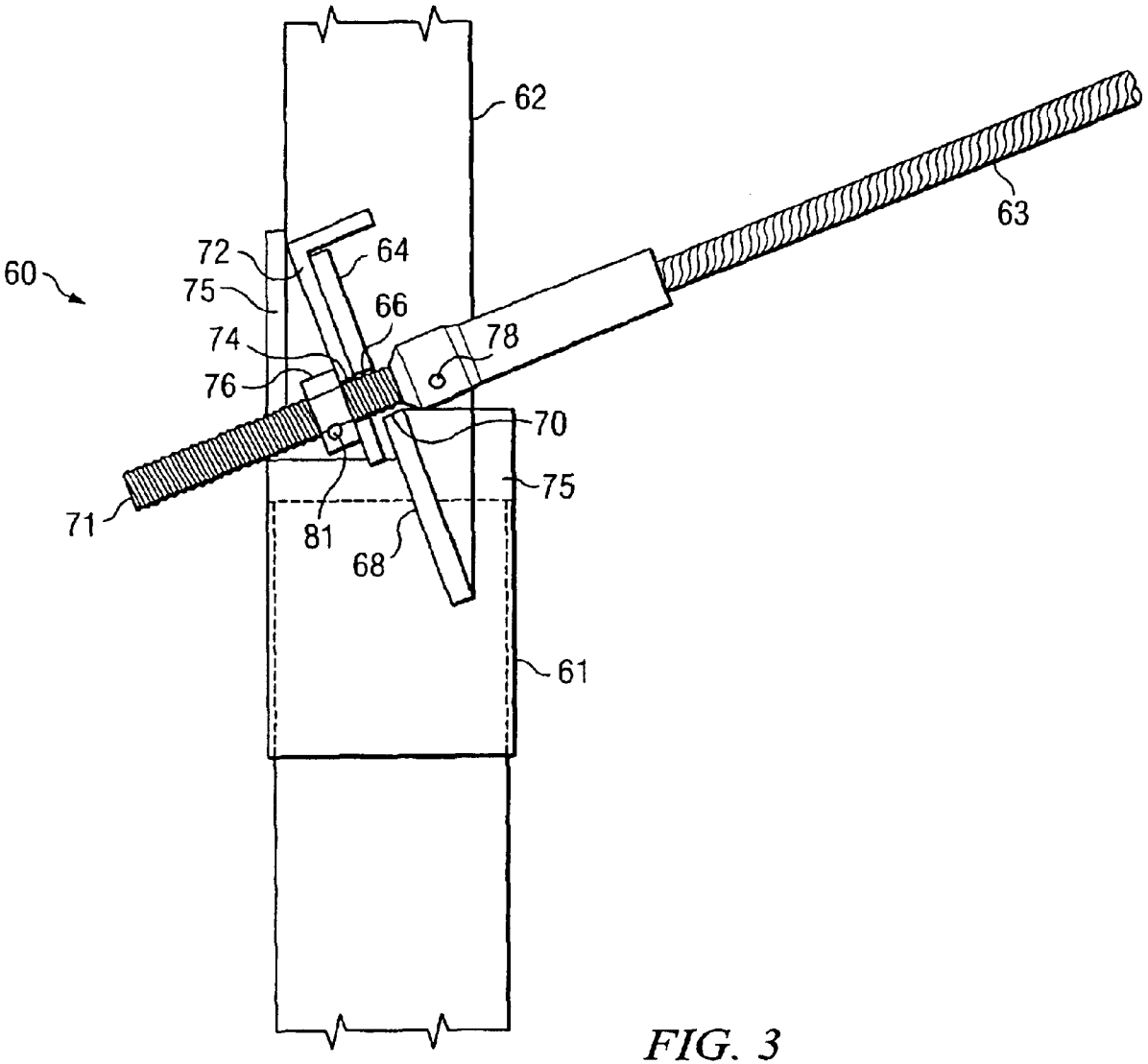
FIG. 3 illustrates portions of a cable release anchor post, in accordance with an embodiment of the present invention.

FIG. 3 illustrates portions of a cable release anchor post 60, in accordance with an embodiment of the present invention. The structure and function of cable release anchor post 60 may be similar to that of cable release anchor posts 12, 14 and 16 of FIG. 1. Cable release anchor post 60 anchors cable 63 in a similar manner to the anchoring of cables 22, 24 and 26 by cable release anchor posts 12, 14 and 16, respectively, of FIG. 1.

Cable release anchor post 60 includes a lower post portion 61 and an upper post portion 62 separably secured to lower post portion 61 at their ends. Particular embodiments may include a cable release anchor post in which the upper and lower post portions are of different types. For example, a cable release anchor post of some embodiments may include an upper post portion having a W6×9 structural shape and a lower post portion having a W6×15 structural shape. Other embodiments may include a cable release anchor post with an upper post portion having a W150×13 structural shape and a lower post portion having a W150×22 structural shape. Some cable release anchor posts may include upper and lower post portions of a similar type but oriented in different ways when secured together to form the post. The lower post portion may be oriented such that the cable forces are resisted by the stronger axis of the structural shape to provide more anchorage capacity and more efficient use of the post portion. In the illustrated embodiment, each of post portions 61 and 62 comprise an I-beam-type cross-section having a pair of flanges and an interconnecting web. However, other embodiments may include cable release anchor posts having other types of cross-sections.

The lower end of upper post portion 62 retains a slanted plate 64, and the upper end of lower post portion 61 retains a slanted plate 68. Slanted plates 64 and 68 each comprise a slanted side, as illustrated, and such sides are retained at substantially the same angles with respect to a longitudinal axis of lower and upper post portions 61 and 62. In one embodiment, the orientation angle of each plate 64 and 68 is approximately twenty degrees as measured from the longitudinal axis of post portion 61 or 62. Welding or other means known in the art may be used to secure slanted plates 64 and 68 at the ends of lower and upper post portions 61 and 62.

The upper edge of slanted plate 68 includes a cutout portion 70, and the lower edge of slanted plate 64 includes a cut-out portion 66. Such cut-out portions 66 and 70 can be clearly seen in FIG. 5. Cut-out portions 66 and 70 may comprise a "U" or other shape. When lower and upper post portions 61 and 62 are coupled to one another, as illustrated in FIG. 3, cut-out portions 66 and 70 of slanted plates 64 and 68, respectively, become aligned with one another to form an opening through which a threaded end 71 of cable 63 is disposed for anchorage. In particular embodiments, the angle of slanted plates 64 and 68 may be approximately perpendicular to the longitudinal axis of cable 63 when anchored by cable release anchor post 60.

Lower and upper post portions 61 and 62 are coupled to respective side plates 75. In FIG. 3, the illustrated side plate 75 coupled to upper post portion 62 couples to slanted plate 68 using bolts or other known means through holes 78, and the side plate 75 coupled to lower post portion 61 couples to slanted plate 64 using bolts or other known means through holes 81.

A connection plate 72 is placed to overlie slanted plate 64 to aid in the release of cable 63 upon vehicle impact as discussed below. Connection plate 72 includes an aperture 74 aligned with cut-out portions 66 and 70. Cable 63 is secured by tightening a nut 76 onto threaded end 71 so that slanted plates 64 and 66 and connection plate 72 are frictionally retained against one another.

Cable release anchor post 60 effectively releases cable 63 to which it is coupled with only a small degree of relative movement of upper post portion 62. In operation, minor movements of upper portion 62 causes cable 63 to release from cable release anchor post 60. Such minor movements may be the result of a vehicle impacting cable release anchor post 60. Such an impact above the point of connection of lower and upper post portions 61 and 62 may urge upper post portion 62 to rotate about the point of connection with lower post portion 61. This rotation ultimately results in the lifting of upper post portion 62 off of lower post portion 61 and the release of cable 63.

Because little relative movement of upper post portion 62 is required to release the cable, the cable is easily released in a collision with the post. This provides a safety advantage during collisions because the likelihood of the impacting vehicle becoming hung up on the cable is reduced.

Figure 4:
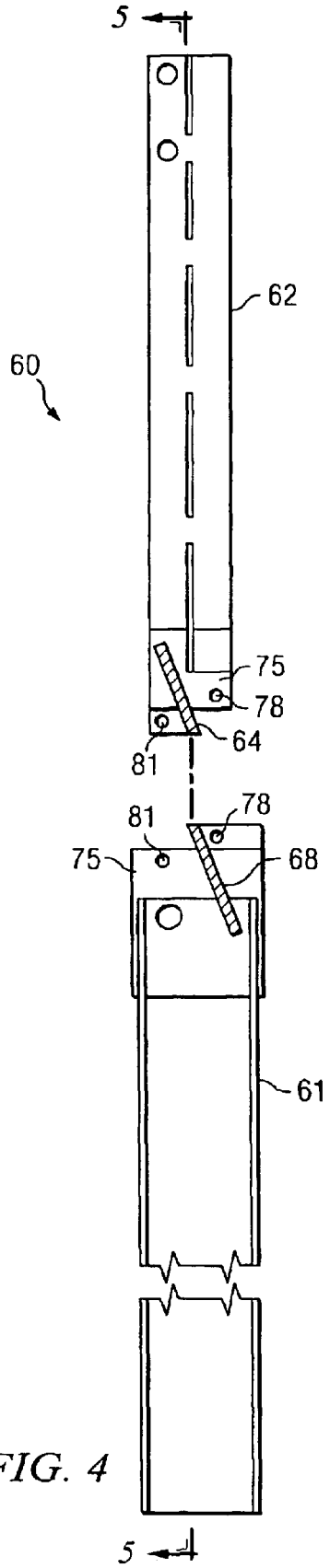
FIG. 4 illustrates portions of the cable release anchor post of FIG. 3 with its lower and upper post portions separated, in accordance with an embodiment of the present invention.
Figure 5:
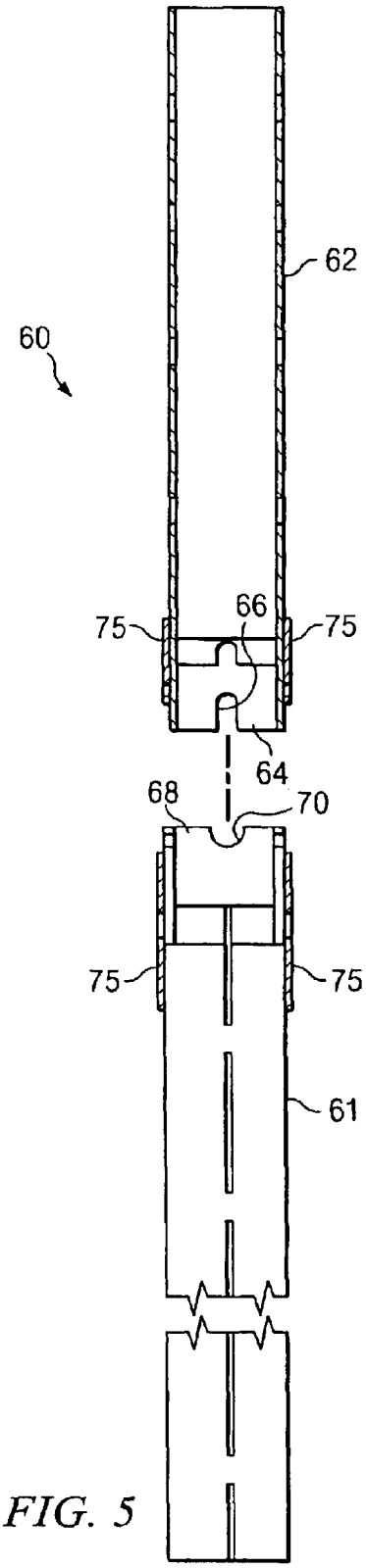
FIG. 5 is a cross-sectional view of the cable release anchor post of FIG. 4 taken along line 5—5 of FIG. 4.

FIGS. 4 and 5 illustrate cable release anchor post 60 with lower and upper post portions 61 and 62 separated. FIG. 5 is a cross-sectional view taken along line 5—5 of FIG. 4. Slanted plates 64 and 68 are illustrated at approximately identical angles relative to the longitudinal axes of lower and upper post portions 61 and 62. As discussed above, when lower and upper post portions are secured together, cut-out portions 66 and 70 align to provide an opening for a cable to be disposed for anchorage by cable release anchor post 60. In particular embodiments, the total length of upper post portion 62 may be approximately 0.772 meters, and the total length of lower post portion 61 may be approximately 1.880 meters.

Cable release anchor post 60 is resistant to release of the cable that it secures (i.e. cable 63 of FIG. 3) in the event of an angled impact to the guardrail system in which it is utilized other than an impact to post 60. An angled impact includes an impact that is angled, or not substantially parallel, to the flow of traffic on the roadway adjacent to which the guardrail system is installed.

Figure 6:
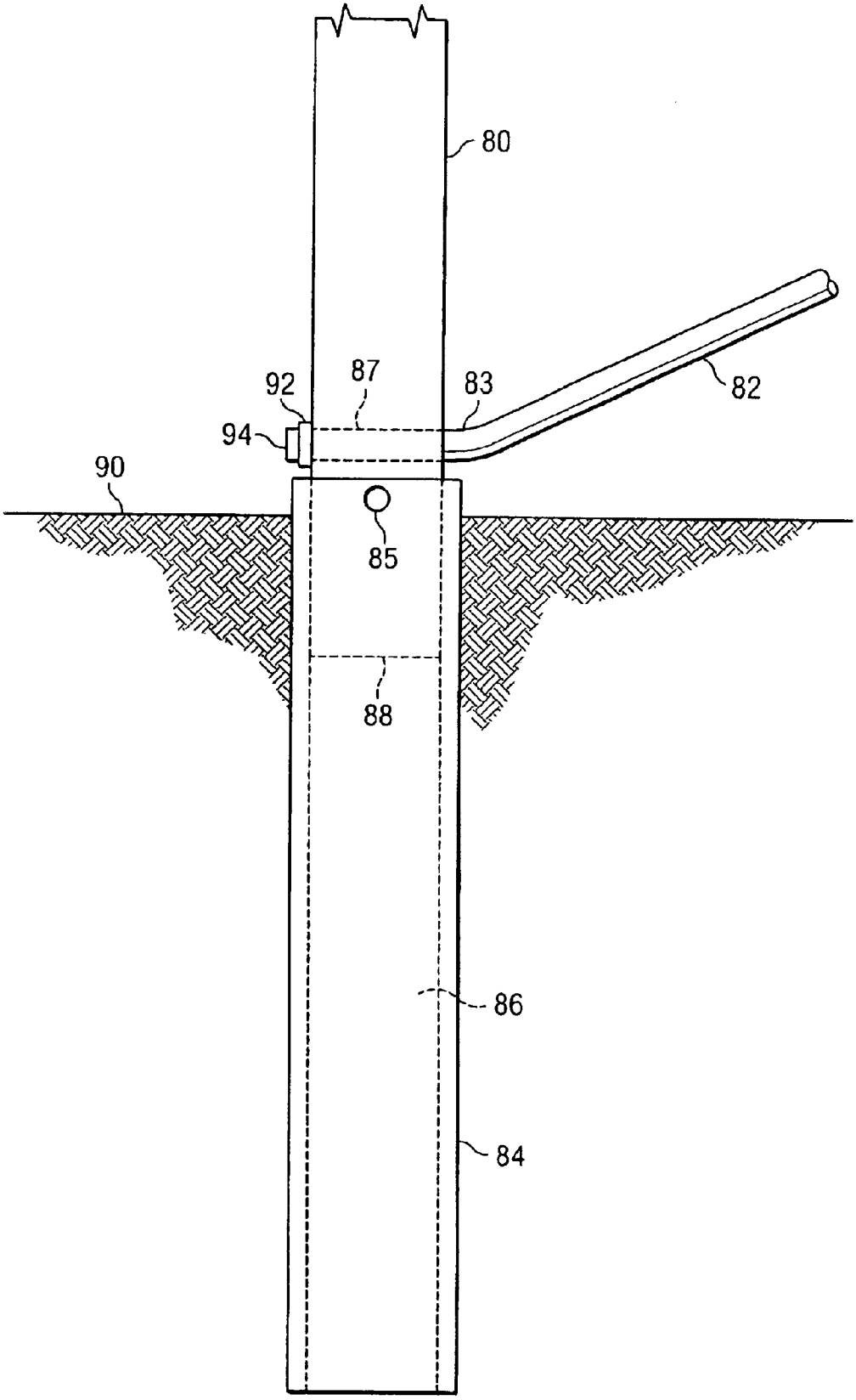
FIG. 6 illustrates another type of cable release anchor post installed in a foundation tube, in accordance with an embodiment of the present invention.

FIG. 6 illustrates a cable release anchor post 80 which is another type of cable release anchor post that may be used in particular embodiments of the present invention. Thus, particular embodiments may utilize cable release anchor post 80 as cable release anchor posts 12, 14 and 16 of FIG. 1. Cable release anchor post 80 may anchor cable 82 as cable release anchor posts 12, 14 and 16 anchor cables 22, 24 and 26, respectively, of FIG. 1.

Cable release anchor post 80 comprises wood and is disposed partially within a foundation tube 84 when installed in a cable guardrail release system. Foundation tube 84 may comprise steel or another suitable material. Foundation tube 84 includes a hollow space 86 which is partially taken up by cable release anchor post 80 when the post is installed. Cable release anchor post 80 and foundation tube 84 include holes 85 for use in securing post 80 to foundation tube 84. Bolts or other suitable components may be used to secure the post. Other embodiments may utilize other techniques or methods known in the art for securing a cable release anchor post to a foundation tube.

When anchored to cable release anchor post 80, a threaded end of cable 82 is disposed through a hole or slot 87 of post 80. Cable 82 may include a bend 83 so that the cable may easily pass through slot 87 if slot 87 is formed horizontally in post 80. A plate 92 and locking nut 94 are utilized to secure and anchor the end of cable 82 to post 80. Other embodiments may include other locking mechanisms to anchor an end of a cable to a wood cable release anchor post. Some embodiments may include a wood cable release anchor post with more than one hole or slot for disposition of an end of a cable, for example, if more than one cable is secured and anchored by the post.

In the event of a vehicle impact to cable release anchor post 80 when the post anchors a cable in a cable guardrail release system, post 80 breaks off from foundation tube 84 thereby releasing cable 83 from anchorage. Thus, the breaking off of post 80 constitutes release of the cable. The wooden composition of post 80 facilitates this break away and release characteristic of the post. Thus, like cable release anchor post 60 of FIG. 3, cable release anchor post 80 fails and releases the cable that it secures and anchors upon a vehicle impact to the post. This feature provides a safety advantage during collisions because the likelihood of the impacting vehicle becoming hung up on the cable is reduced. Moreover, like cable release anchor post 60 of FIG. 3, the design of cable release anchor post 80 aids to resist failure of the post and release of the cable in the event of a vehicle impact to another section of a cable guardrail release system in which the post is utilized, such as a length of need section of the system. Thus, the redirective abilities of the system in the event of an impact to another section may be maintained.

In particular embodiments, the length of cable release anchor post 80 may be approximately 0.9 to 1.1 meters, and the length of foundation tube 84 may be approximately 1.5 to 1.6 meters. When cable release anchor post 80 is installed in a guardrail release system of some embodiments, a bottom end 88 of the post may extend approximately 0.3 to 0.4 meters below a ground surface 90.

Particular embodiments described herein discuss two particular types of cable release anchor posts, cable release anchor post 60 of FIGS. 3–5 and cable release anchor post 80 of FIG. 6. It should be understood that terminal systems of other embodiments may utilize other types of cable release anchor posts that secure one or more cables and provide release from anchorage of one or more cables upon a vehicle impact to the particular post that anchors the one or more cables.

Figure 7:
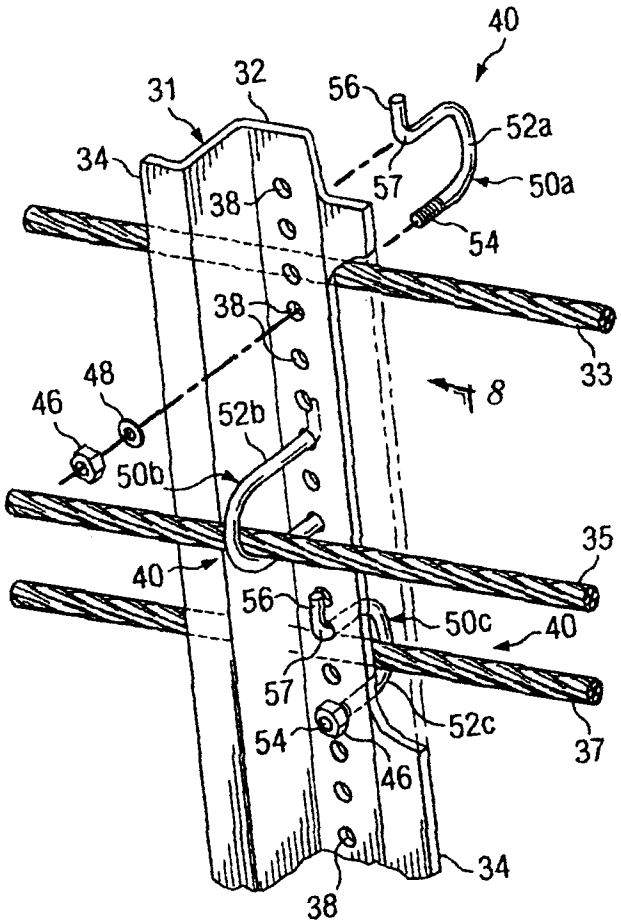
FIG. 7 is an isometric view of a portion of an intermediate support post of a cable guardrail release system, in accordance with an embodiment of the present invention.

FIG. 7 is an isometric view of a portion of an intermediate support post 31 of a cable guardrail release system, in accordance with an embodiment of the present invention. The structure and function of intermediate support post 31 may be similar to that of intermediate support posts 18 and 20 of FIG. 1. Cables 33, 35 and 37 (upper cable 33, middle cable 35 and lower cable 37) are each secured to intermediate support post 31 by locking assemblies 40. In particular embodiments, the total length of intermediate support post 31 may be approximately 1.6 meters.

As illustrated, intermediate support post 31 includes an approximately "U-shaped" cross-section with a central web portion 32 and a pair of oppositely directed flanges 34. Apertures 38 are disposed through web portion 32. In the illustrated embodiment, upper and lower cables 33 and 37 run along and are secured to one side of intermediate support post 31 while middle cable 35 runs along and is secured to an opposite side of intermediate support post 31. This arrangement helps to accommodate impacts on either side of the cable guardrail safety system in which intermediate support post 31 is utilized. Impacts on either side of a guardrail system might be expected when the system is installed at a median.

As stated above, locking assemblies 40 are used to secure cables 33, 35 and 37 to intermediate support post 31. Each locking assembly 40 comprises a bolt member 50 having a threaded end 54 and a nut 46 that may be threadably coupled to threaded end 54. A lock washer 48 may be used in coupling nut 46 to bolt members 50.

Each bolt member 50 has a unitary body with a U-shaped, arcuate portion 52. Arcuate portion 52 presents threaded end 54 to which nut 46 is threadably coupled. Each bolt member 50 also includes a substantially straight, pigtail portion 56 that is located opposite threaded end 54. Pigtail portion 56 is oriented at an approximately ninety degree angle to arcuate portion 52 by virtue of bend 57. It should be understood that other types of bolt members known in the art may be used to secure cables to intermediate support posts. For example, particular embodiments may utilize J-shaped bolts for such purposes.

In particular embodiments of the present invention, cable 33 may be secured to intermediate support post 31 approximately 0.725 to 0.750 meters above the ground surface, cable 35 may be secured to intermediate support post 31 approximately 0.525 to 0.650 meters above the ground surface and cable 37 may be secured to intermediate support post 31 approximately 0.510 to 0.545 meters above the ground surface. These heights may also be used for securing cables 22, 24 and 26 to intermediate support posts of FIGS. 1 and 2.

Figure 8:
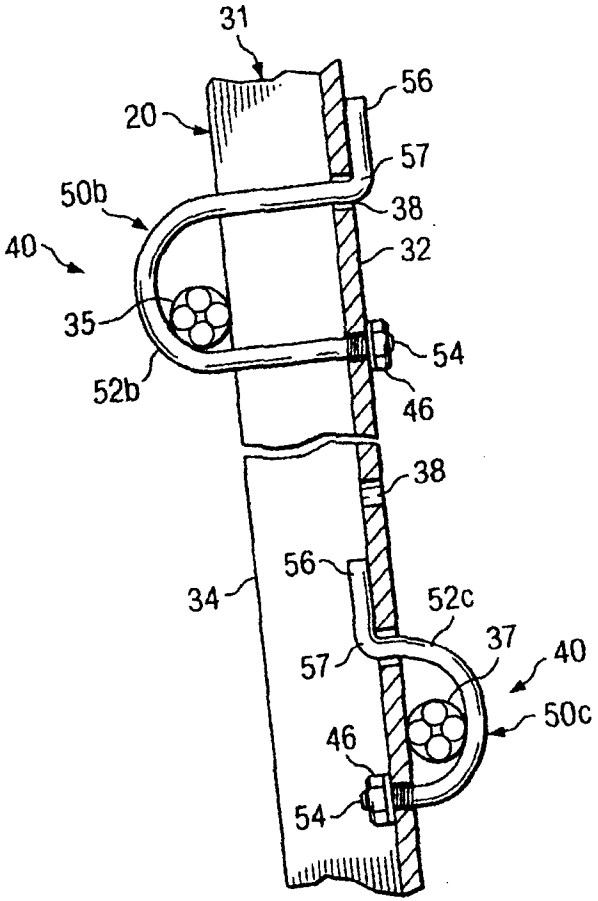
FIG. 8 is a side view of a portion of the intermediate support post of FIG. 7, in accordance with an embodiment of the present invention.

FIG. 8 is a side view of a portion of intermediate support post 31 of FIG. 7. Two varieties of bolt members 50 are illustrated. Bolt members 50*a* and 50*c* of FIG. 7 comprise one variety, while bolt member 52*b* comprises the other variety. Bolt members 50*b* and 50*c* are illustrated in FIG. 8. Bolt member 50*c* has a shortened arcuate portion 52*c* as compared to arcuate portion 52*b* of bolt member 50*b*. Arcuate portion 52*c* of bolt member 50*c* is approximately half as long (as measured from the inside of the center of the curved portion to the end of threaded portion 54) as arcuate portion 52*b* of bolt member 50*b*.

In operation, bolt members 50*a*, 50*b* and 50*c* secure cables 33, 35 and 37, respectively, to intermediate support post 31 of a cable guardrail release system. For each of cables 33, 35 and 37, arcuate portions 52 of bolt members 50 are placed adjacent the body of the cable to be secured.

To install a locking assembly 40, pigtail portion 56 of bolt member 50 is inserted through a respective aperture 38 in intermediate support post 31. Bolt member 50 is then rotated (downwardly or upwardly depending upon the direction of insertion) so that bend 57 is disposed within the aperture. Each threaded end 54 is inserted through a respective aperture 38 proximate the aperture through which pigtail portion 56 is inserted. Washer 48 and nut 46 are secured to threaded end 54. Because arcuate portion 52*b* of bolt member 50*b* is longer than arcuate portions 52*a* and 52*c* of bolt members 50*a* and 50*c*, respectively, bolt member 50*b* is suitable for securing a cable in contact with flanges 34 while nut 46 and pigtail portion 56 are positioned on the opposite side of central web portion 32. Bolt members 50*a* and 50*c* secure a cable in contact with web portion 32. Thus, bolt member 50*b* is suitable for securing middle cable 35 to a side of intermediate support post 31 that is opposite the side that upper and lower cables 33 and 37 are secured to through bolt members 50*a* and 50*c*, respectively.

It should be understood that while particular embodiments of the present invention utilize intermediate support posts similar to intermediate support post 31 of FIGS. 7 and 8, other embodiments may utilize other types of intermediate support posts known in the art. For example, some embodiments may utilize S3×5.7 posts, and some embodiments may utilize channel-shaped posts. Moreover, as discussed above, particular embodiments may utilize other mechanisms to secure the cables to intermediate support posts.

The above-described features collectively provide an efficient and effective barrier having many advantages. Cable guardrail release systems in accordance with particular embodiments of the present invention provide redirective capabilities, as described above, as a result of the anchorage of the cables at the cable release anchor posts. In addition, each cable release anchor post is readily collapsible during a collision with the post. Moreover, in such a collision, the particular cable release anchor post is able to separately release any cables secured by such post for added safety.

Although the present invention has been described in detail, various changes and modifications may be suggested to one skilled in the art. It is intended that the present invention encompass such changes and modifications as falling within the scope of the appended claims.

What is claimed is:

1. A cable guardrail release system, comprising:

a first number of anchor posts for installation adjacent a roadway, each of the first number of anchor posts being configured to secure an end of a respective cable;

wherein each anchor post is configured to release the respective cable upon a vehicle impact to the anchor post;

wherein each of the first number of anchor posts comprises:

an upper portion comprising a first shape, the upper portion retaining a first slanted plate at a lower end of the upper portion, the first slanted plate having a first cutout at its lower end;

a lower portion coupled to the upper portion for installation at least partially below grade adjacent the roadway, the lower portion comprising a second shape, the lower portion retaining a second slanted plate at an upper end of the lower portion, the second slanted plate having a second cutout at its upper end;

wherein the first slanted plate is adjacent the second slanted plate such that the first cutout of the upper portion and the second cutout of the lower portion align together to form an opening through which the end of the respective cable is disposed; and wherein the upper portion is operable to move relative to the lower portion and release the respective cable upon the vehicle impact to the anchor post.

2. The cable guardrail release system of claim 1, wherein the support posts are installed in approximate alignment with each other and wherein the distance between two successive support posts is approximately two to five meters.

3. The cable guardrail release system of claim 1, wherein the first number of anchor posts comprises three anchor posts.

4. The cable guardrail release system of claim 1, wherein the first number of anchor posts comprises four anchor posts.

5. The cable guardrail release system of claim 1, wherein the first number of anchor posts are installed in approximate alignment with each other and wherein the distance between two successive anchor posts is approximately 1.9 meters.

6. The cable guardrail release system of claim 1, wherein the first shape comprises a W150×13 structural shape.

7. The cable guardrail release system of claim 1, wherein the second shape comprises a W150×22 structural shape.

8. The cable guardrail release system of claim 1, wherein each of the first number of anchor posts comprises a wood post, each wood post at least partially disposed in a foundation tube and each wood post comprising a slot through which the end of the respective cable secured by the anchor post is disposed.

9. The cable guardrail release system of claim 8, wherein each wood post comprises a length of approximately 0.9 to 1.1 meters and wherein each wood post extends in the foundation tube approximately 0.3 to 0.4 meters below a ground surface.

10. A cable guardrail release system, comprising:

a plurality of anchor post for installation adjacent a roadway, each anchor post being configured to secure an end of at least one of a plurality of cables;

wherein each anchor post us configured to release the end of the at least one of the plurality of cables upon a vehicle impact to the anchor post;

wherein each anchor post comprises:

an upper portion comprising a first shape, the upper portion retaining a first slanted plate at a lower end of the upper portion, the first slanted plate having a first cutout at its lower end;

a lower portion coupled to the upper portion for installation at least partially below grade adjacent the roadway, the lower portion comprising a second shape, the lower portion retaining a second slanted plate at an upper end of the lower portion, the second slanted plate having a second cutout at its upper end;

wherein the first slanted plate is adjacent the second slanted plate such that the first cutout of the upper portion and the second cutout of the lower portion align together to form an opening through which the end of the at least one of the plurality of cables may be disposed; and wherein the upper portion is operable to move relative to the lower portion and release the end of the at least one of the plurality of cables upon the vehicle impact to the anchor post.

11. The cable guardrail release system of claim 10, further comprising a length of need section, the length of need section comprising:

a plurality of intermediate support posts, each intermediate support post configured to support each of the plurality of cables;

portions of each of the plurality of cables running in between the plurality of intermediate support posts; and wherein each anchor post is configured to resist release of the end of the at least one the plurality of cables secured by the anchor post upon a vehicle impact to the length of need section generally at an angle to the flow of traffic on the roadway.

12. The cable guardrail release system of claim 10, wherein:

the plurality of anchor posts comprises two anchor posts;

the plurality of cables comprises four cables; and each of the two anchor posts secures an end of two of the four cables.

13. The cable guardrail release system of claim 10, wherein the first shape comprises a W150×13 structural shape.

14. The cable guardrail release system of claim 10, wherein the second shape comprises a W150×22 structural shape.

15. The cable guardrail release system of claim 10, wherein each anchor post comprises a wood post, each wood post at least partially disposed in a foundation tube and each wood post comprising at least one slot through which the end of the at least one of the plurality of cables secured by the anchor post is disposed.

16. The cable guardrail release system of claim 13, wherein each wood post comprises a length of approximately 0.9 to 1.1 meters and wherein each wood post extends in the foundation tube approximately 0.3 to 0.4 meters below a ground surface.

* * * * *